US007677230B2

(12) United States Patent
Meyer et al.

(10) Patent No.: US 7,677,230 B2
(45) Date of Patent: Mar. 16, 2010

(54) INTERNAL COMBUSTION ENGINE WITH MULTIPLE SPARK PLUGS PER CYLINDER AND ION CURRENT SENSING

(75) Inventors: Daniel Lawrence Meyer, Dearborn, MI (US); Chris Paul Glugla, Macomb, MI (US); Michael Damian Czekala, Canton, MI (US); Michelle M. Hutchison, Canton, MI (US); Ben Allen Strayer, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 156 days.

(21) Appl. No.: 11/929,949

(22) Filed: Oct. 30, 2007

(65) Prior Publication Data

US 2009/0107457 A1 Apr. 30, 2009

(51) Int. Cl.
*F02P 15/08* (2006.01)

(52) U.S. Cl. ..... 123/638; 123/605; 123/618

(58) Field of Classification Search ..... 123/638, 123/605, 608, 618, 634, 635, 636
See application file for complete search history.

(56) References Cited

U.S. PATENT DOCUMENTS

| | | | | |
|---|---|---|---|---|
| 4,462,380 | A | 7/1984 | Asik | |
| 5,321,978 | A * | 6/1994 | Brandt et al. | 73/114.08 |
| 5,425,339 | A | 6/1995 | Fukui | |
| 5,954,024 | A | 9/1999 | Duhr et al. | |
| 6,054,859 | A | 4/2000 | Takahashi et al. | |
| 6,211,680 | B1 | 4/2001 | Hohner et al. | |
| 6,246,952 | B1 | 6/2001 | Honda | |
| 6,520,149 | B2 | 2/2003 | Kokubo et al. | |
| 6,536,406 | B2 | 3/2003 | Matsubara et al. | |
| 6,748,922 | B2 | 6/2004 | Uchida et al. | |
| 6,860,256 | B2 | 3/2005 | Nakamura et al. | |
| 6,883,509 | B2 | 4/2005 | Porter et al. | |
| 6,886,547 | B2 | 5/2005 | Butler, Jr. | |
| 6,910,449 | B2 | 6/2005 | Strom et al. | |
| 6,922,628 | B2 | 7/2005 | Zhu et al. | |
| 6,945,229 | B1 | 9/2005 | Zhu et al. | |
| 6,951,201 | B2 | 10/2005 | Zhu et al. | |
| 7,005,855 | B2 | 2/2006 | Zhu et al. | |
| 7,059,296 | B2 | 6/2006 | Strom et al. | |
| 7,086,382 | B2 | 8/2006 | Daniels et al. | |

(Continued)

FOREIGN PATENT DOCUMENTS

GB 2396754 A 6/2004

OTHER PUBLICATIONS

Yutaka Ohashi et al., The Application of Ionic Current Detection System for the Combustion Condition Control, SAE 1999-01-0550, Mar. 1-4, 1999.

(Continued)

*Primary Examiner*—Hai H Huynh
(74) *Attorney, Agent, or Firm*—Julia Voutyras; Brooks Kushman P.C.

(57) ABSTRACT

A system and method for operating a multiple cylinder internal combustion engine having at least two spark plugs per cylinder include selectively isolating all but one spark plug associated with the cylinder at least during an ionization current sensing period to reduce or eliminate interference among ionization current signals flowing through more than one spark plug.

20 Claims, 4 Drawing Sheets

U.S. PATENT DOCUMENTS

| | | | |
|---|---|---|---|
| 7,156,070 | B2 | 1/2007 | Strom et al. |
| 7,251,557 | B2 | 7/2007 | Strom et al. |
| 7,255,080 | B1 | 8/2007 | Leone |
| 7,268,655 | B2 | 9/2007 | Skinner et al. |
| 2004/0083717 | A1 | 5/2004 | Zhu et al. |
| 2004/0083794 | A1 | 5/2004 | Zhu et al. |
| 2004/0084018 | A1 | 5/2004 | Zhu et al. |
| 2004/0084019 | A1 | 5/2004 | Zhu et al. |
| 2004/0084025 | A1 | 5/2004 | Zhu et al. |
| 2004/0084026 | A1 | 5/2004 | Zhu et al. |
| 2004/0084034 | A1 | 5/2004 | Huberts et al. |
| 2004/0084035 | A1 | 5/2004 | Newton |
| 2004/0085068 | A1 | 5/2004 | Zhu et al. |
| 2004/0085069 | A1 | 5/2004 | Zhu et al. |
| 2004/0085070 | A1 | 5/2004 | Daniels et al. |
| 2004/0088102 | A1 | 5/2004 | Daniels et al. |
| 2005/0028786 | A1 | 2/2005 | Zhu et al. |
| 2005/0050948 | A1 | 3/2005 | Zhu et al. |
| 2005/0055169 | A1 | 3/2005 | Zhu et al. |
| 2005/0090966 | A1 | 4/2005 | Strom et al. |
| 2005/0126537 | A1 | 6/2005 | Daniels et al. |
| 2005/0211219 | A1 | 9/2005 | Strom et al. |
| 2005/0247064 | A1 | 11/2005 | Lieuwen |
| 2006/0042355 | A1 | 3/2006 | Zhu et al. |
| 2006/0091987 | A1 | 5/2006 | Skinner et al. |
| 2006/0241848 | A1 | 10/2006 | Strom et al. |
| 2007/0095326 | A1 | 5/2007 | Strom et al. |
| 2007/0215101 | A1 | 9/2007 | Russell et al. |
| 2007/0215102 | A1 | 9/2007 | Russell et al. |
| 2007/0215104 | A1 | 9/2007 | Hahn |
| 2007/0215107 | A1 | 9/2007 | Shelby et al. |
| 2007/0215111 | A1 | 9/2007 | Surnilla |
| 2007/0215130 | A1 | 9/2007 | Shelby et al. |

OTHER PUBLICATIONS

Schneider et al., Real-Time Air/Fuel-Ration Control in a Small SI Engine Using the Ionic Current Signal, SAE 1999-01-3323, JSAE 9938078, Sep. 28-30, 1999.

Wilstermann et al., Ignition System Integrated AC Ion Current Sensing for Robust and Reliable Online Engine Control, SAE 2000-01-0553, Mar. 6-9, 2000.

Schneider et al., An Investigation of the Impact of Cycle-to-Cycle Variations on the Ionic Current Signal in SI Engines, SAE 2000-01-1943, Jun. 19-22, 2000.

Toon de Bie, et al. A Novel Start Algorithm for CNG Engines Using Ion Sense Technology, SAE 2000-01-2800, Oct. 16-19, 2000.

Noriaki Kondo, et al., Combustion Monitoring by use of the Spark Plug for DI Engine, SAE 2001-01-0994, Mar. 5-8, 2001.

Yoshiyama, et al., Combustion Diagnostics of a Spark Ignition Engine Using a Spark Plug as an Ion Probe, SAE 2002-01-2838, Oct. 21-24, 2002.

Malaczynski, et al., Real-Time Digital Signal Processing of Ionization Current for Engine Diagnostic and Control, SAE 2003-01-1119, Mar. 3-6, 2003.

Strandh, et al., Ion Current Sensing for HCCI Combustion Feedback, SAE 2003-01-3216, 2003.

Huang, et al., Effects of Engine Operating Conditions on In-Cylinder Air/Fuel Ratio Detection Using a Production Ion Sensing Device, SAE 2004-01-0515, Mar. 8-11, 2004.

Vressner, et al., Multiple Point Ion Current Diagnostics in an HCCI Engine, SAE 2004-01-0934, Mar. 8-11, 2004.

Shimasaki, et al., Study on Combustion Monitoring System for Formula One Engines Using Ionic Current Measurement, SAE 2004-01-1921, Jun. 8-10, 2004.

Huang, Yiqun, et al., Investigation of an In-cylinder Ion Sensing Assisted HCCI Control Strategy, SAE2005-01-0068, Apr. 11-14, 2005.

Vressner, et al., Fuel Effects on Ion Current in an HCCI Engine, SAE 2005-01-2093, 2005.

Yoshiyama, et al., Ion Current During the Exhaust Process Under the Idling Condition in a Spark Ignition Engine, SAE 2005-01-3872, Oct. 24-27,2005.

Rado, et al., Significance of Burn Types, as Measured by Using the Spark Plugs as Ionization Probes, with Respect to the Hydrocarbon Emission Levels in S.I. Engines, SAE 750354, Feb. 24-28, 1975.

Saltzkoff, et al., An Ionization Equilibrium Analysis of the Spark Plug as an Ionization Sensor, SAE960337, Feb. 26-29, 1996.

Fei An, et al., Combustion Diagnostics in Methane-Fueled SI Engines Using the Spark Plug as an Ionization Probe, SAE970033, Feb. 24-27, 1997.

Eriksson, et al., Closed Loop Ignition Control by Ionization Current Interpretation, SAE 970854, Feb. 24-27, 1997.

Reinmann, et al., Local Air-Fuel Ratio Measurements Using the Spark Plug as an Ionization Sensor, SAE 970856, Feb. 24-27, 1997.

Saltzkoff, et al., In-Cylinder Pressure Measurements Using the Spark Plug as an Ionization Sensor, SAE 970857, Feb. 24-27, 1997.

Asano, et al., Development of New Ion Current Combustion Control System, SAE 980162, Feb. 23-26, 1998.

Balles, et al., In-Cylinder Air/Fuel Ratio Approximation Using Spark Gap Ionization Sensing, SAE 980166, Feb. 23-26, 1998.

Ohashi, et al., The Application of Ionic Current Detection System for the Combustion Limit Control, SAE 980171, Feb. 23-26, 1998.

Schneider, et al., An Investigation of the Impact of Cycle-to-cycle Variations on the Ionic Current Signal in SI Engines, SAE 2000-01-1943, Jun. 19-22, 2000.

* cited by examiner

INTERNAL COMBUSTION ENGINE WITH MULTIPLE SPARK PLUGS PER CYLINDER AND ION CURRENT SENSING

BACKGROUND

1. Technical Field

The present disclosure relates to systems and methods for ionization current sensing in multiple cylinder internal combustion engines having two or more spark plugs per cylinder.

2. Background Art

Manufacturers continue to improve control of internal combustion engines to enhance fuel economy and performance while reducing feedgas emissions using more sophisticated sensing and processing hardware and software. To improve control of the combustion process, ionization current sensing (or ion sense) uses a bias voltage applied across a sensor positioned within the combustion chamber to generate a current signal indicative of the combustion quality and timing. For spark-ignition engines, one or more spark plugs may be used as an ion sensor with the bias voltage applied across the air gap of the spark plug, or between a spark plug electrode and the cylinder wall.

Spark-ignited internal combustion engines may be configured with ignition systems that feature two or more spark plugs for each cylinder to accommodate flexible fuel applications or to provide more ignition energy for leaner air/fuel ratios to improve combustion and enhance fuel economy, for example. Multiple spark plugs may be powered from a common ignition coil to improve cost effectiveness of these applications. However, multi-plug applications powered by a common ignition coil present various challenges for implementing ion sensing technology. For example, combining or summing ionization current signals from two or more spark plugs or other ion sensors on a common signal line may result in attenuation or cancellation of high frequency components and associated variation in the ion sensing signal that is difficult to correlate with actual combustion performance. Differences in spark durations between two or more spark plugs can mask ion signals for a portion of the engine cycle so that combustion information is unavailable. In addition, electrical and magnetic coupling of the spark discharge can also distort the ion sense signal.

SUMMARY

A system and method for operating a multiple cylinder internal combustion engine having at least two spark plugs per cylinder include selectively isolating all but one spark plug associated with the cylinder at least during an ionization current sensing period to reduce or eliminate interference among ionization current signals flowing through more than one spark plug.

In one embodiment a multiple cylinder internal combustion engine includes first and second spark plugs per cylinder with the first spark plug connected to a first secondary winding of an ignition coil and the second spark plug connected through an ion sensing attenuator to the second secondary winding of the ignition coil, the attenuator filtering or blocking an ion sensing current from passing through the second spark plug during an ion sensing period after spark discharge. In one embodiment, the attenuator is implemented by an air gap within the conductor connecting the second spark plug to the second secondary winding of the ignition coil. In another embodiment, the conductor connecting the second spark plug to the second secondary winding filters the ion current signal to attenuate selected frequency ranges of the ion current signal.

The present disclosure includes embodiments having various advantages. For example, the systems and methods of the present disclosure can provide ionization current sensing in applications having two or more spark plugs or other ionization sensors for each cylinder that are powered from a common coil or conductor. Using a common power source may reduce cost relative to applications that have an ionization sensing coil for each plug while still providing ionization current sensing for each cylinder. Attenuating or isolating all but one plug associated with a particular cylinder reduces signal processing complexity and may result in more reliable ionization current signals that are better correlated with combustion timing and efficiency.

The above advantages and other advantages and features will be readily apparent from the following detailed description of the preferred embodiments when taken in connection with the accompanying drawings.

DETAILED DESCRIPTION OF THE DRAWINGS

Figure 4:
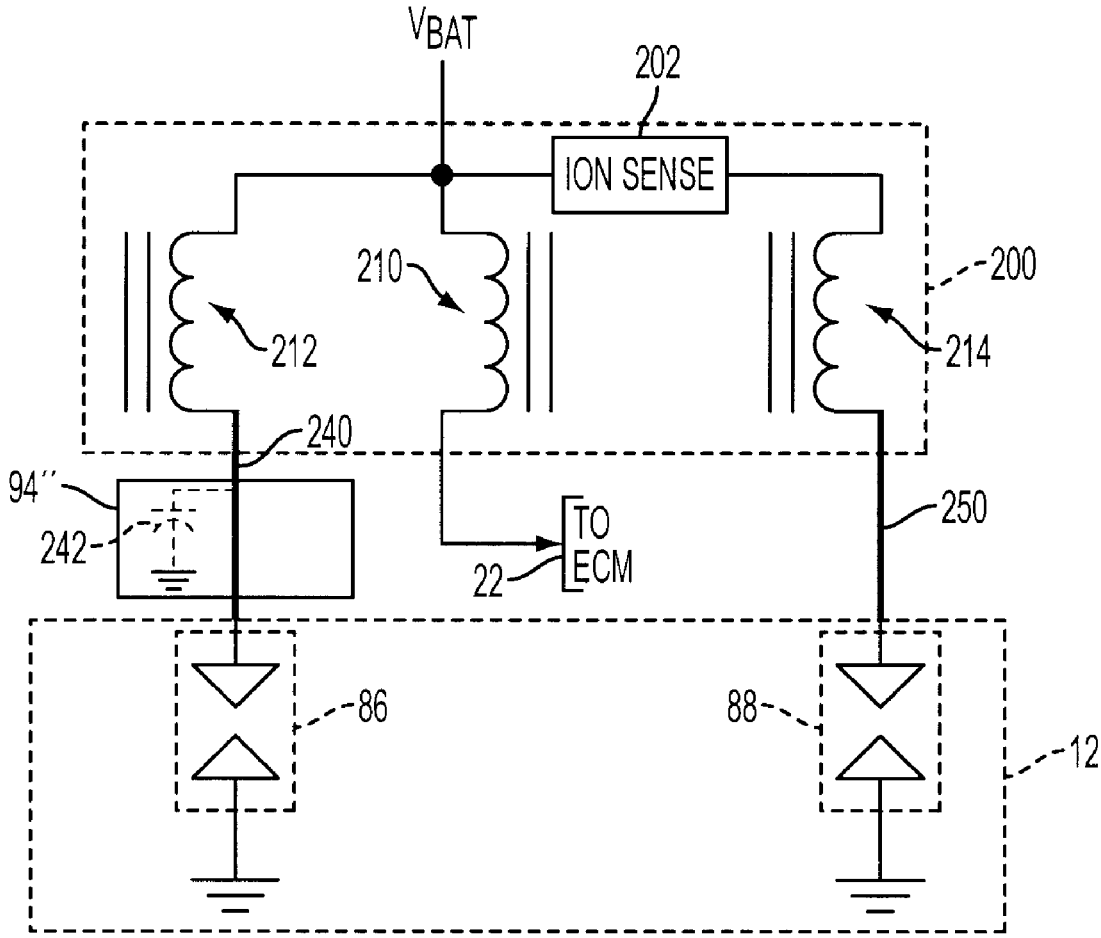
Figure 5:
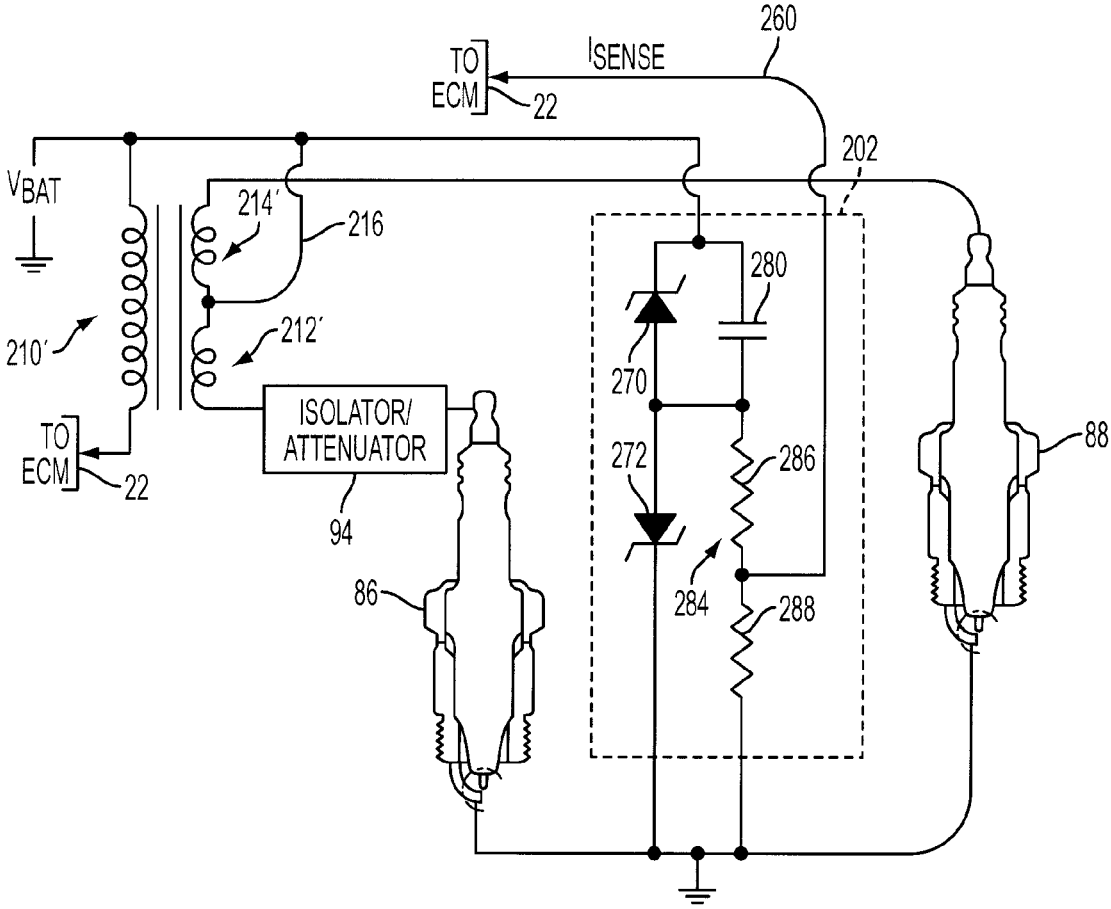

FIG. 4 is a simplified schematic illustrating an integrally tuned spark plug conductor to filter or attenuate selected frequencies of an ionization current signal according to one embodiment of the present disclosure; and FIG. 5 is a simplified schematic illustrating a center-tap ignition coil and ion sense circuit with one spark plug connected to the ignition coil via an isolator/attenuator according to one embodiment of the present disclosure.

DETAILED DESCRIPTION OF EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a, multi-cylinder, internal combustion engine with direct or in-cylinder injection and an ion sensing system that uses a spark plug, glow plug, or dedicated ionization sensor disposed within the cylinders. Those of ordinary skill in the art may recognize similar applications or implementations with other engine/vehicle technologies.

System 10 includes an internal combustion engine having a plurality of cylinders, represented by cylinder 12, with corresponding combustion chambers 14. As one of ordinary skill in the art will appreciate, system 10 includes various sensors and actuators to effect control of the engine. A single sensor or actuator may be provided for the engine, or one or more sensors or actuators may be provided for each cylinder 12, with a representative actuator or sensor illustrated and described. For example, each cylinder 12 may include four actuators that operate intake valves 16 and exhaust valves 18 for each cylinder in a multiple cylinder engine. However, the engine may include only a single engine coolant temperature sensor 20.

Controller 22, sometimes referred to as an engine control module (ECM), powertrain control module (PCM) or vehicle control module (VCM), has a microprocessor 24, which is part of a central processing unit (CPU), in communication with memory management unit (MMU) 25. MMU 25 controls the movement of data among various computer readable storage media and communicates data to and from CPU 24. The computer readable storage media preferably include volatile and nonvolatile storage in read-only memory (ROM) 26, random-access memory (RAM) 28, and keep-alive memory (KAM) 30, for example. KAM 30 may be used to store various operating variables while CPU 24 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 24 in controlling the engine or vehicle into which the engine is mounted. The computer-readable storage media may also include floppy disks, CD-ROMs, hard disks, and the like.

System 10 includes an electrical system powered at least in part by a battery 116 providing a nominal voltage, $V_{BAT}$, which is typically either 12V or 24V, to power controller 22. As will be appreciated by those of ordinary skill in the art, the nominal voltage is an average design voltage with the actual steady-state and transient voltage provided by the battery varying in response to various ambient and operating conditions that may include the age, temperature, state of charge, and load on the battery, for example. Power for various engine/vehicle accessories may be supplemented by an alternator/generator during engine operation as well known in the art. A high-voltage power supply 120 may be provided in applications using direct injection and/or to provide the bias voltage for ion current sensing. Alternatively, ion sensing circuitry may be used to generate the bias voltage using the ignition coil and/or a capacitive discharge circuit as described in greater detail with reference to FIG. 5.

Figure 1:
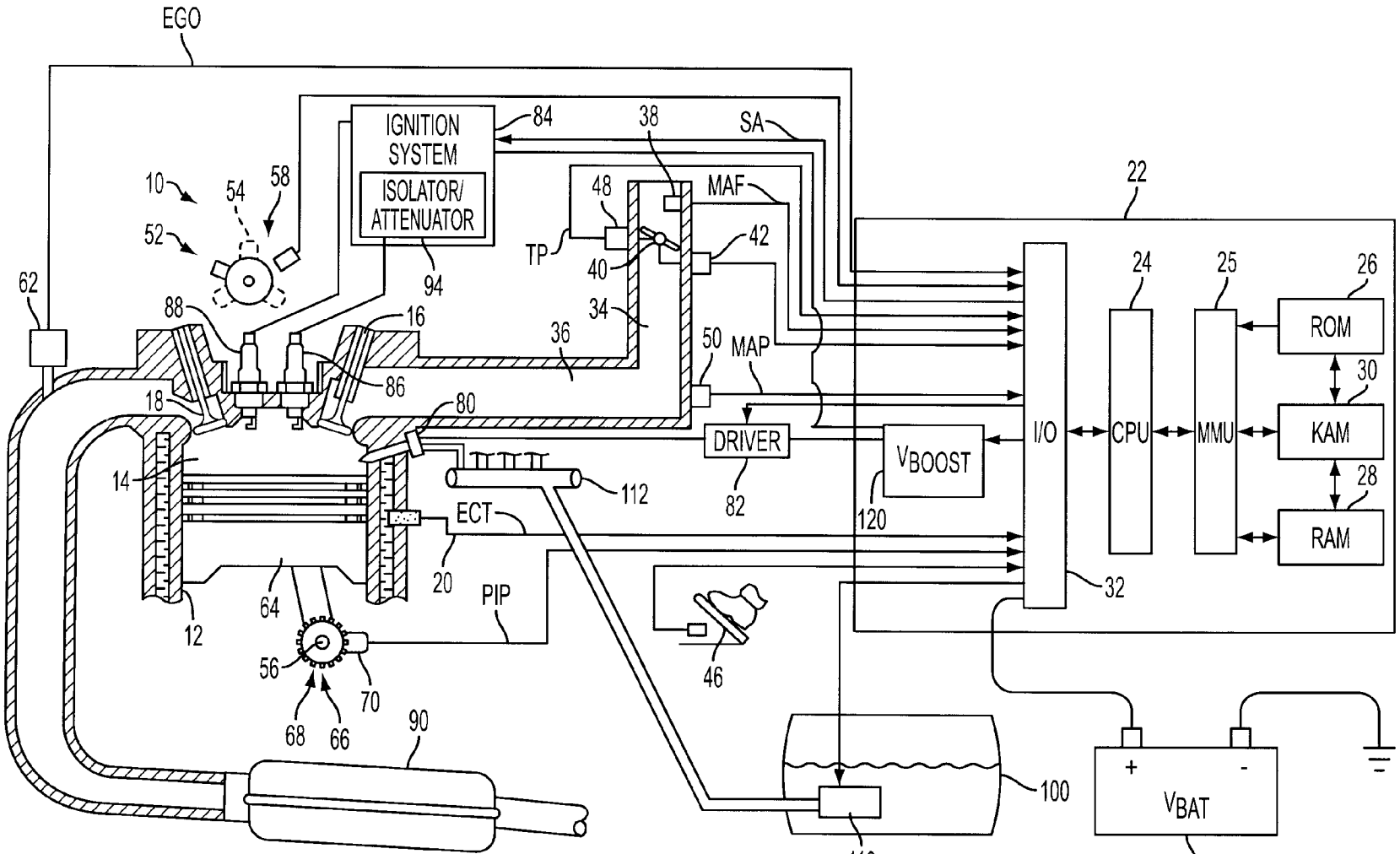
FIG. 1 is a block diagram illustrating operation of a system or method for controlling a multiple-plug-per-cylinder internal combustion engine having a common ignition coil with ionization current sensing according to one embodiment of the present disclosure.

In applications having a separate high-voltage power supply, power supply 120 generates a boosted nominal voltage, $V_{BOOST}$, relative to the nominal battery voltage and may be in the range of 85V-100V, for example, depending upon the particular application and implementation. Power supply 120 may be used to power fuel injectors 80 and one or more ionization sensors, which may be implemented by spark plugs 86, 88. As illustrated in the embodiment of FIG. 1, the high-voltage power supply 120 may be integrated with control module 22. Alternatively, an external high-voltage power supply may be provided if desired. Although illustrated as a single functional block in FIG. 1, some applications may have multiple internal or external high-voltage power supplies 120 that each service components associated with one or more cylinders or cylinder banks, for example.

CPU 24 communicates with various sensors and actuators via an input/output (I/O) interface 32. Interface 32 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 24. Examples of items that are actuated under control by CPU 24, through I/O interface 32, are fuel injection timing, fuel injection rate, fuel injection duration, throttle valve position, spark plug ignition timing (in the event that engine 10 is a spark-ignition engine), ionization current sensing and conditioning, and others. Sensors communicating input through I/O interface 32 may indicate piston position, engine rotational speed, vehicle speed, coolant temperature, intake manifold pressure, accelerator pedal position, throttle valve position, air temperature, exhaust temperature, exhaust air to fuel ratio, exhaust constituent concentration, and air flow, for example. Some controller architectures do not contain an MMU 25. If no MMU 25 is employed, CPU 24 manages data and connects directly to ROM 26, RAM 28, and KAM 30. Of course, the present invention could utilize more than one CPU 24 to provide engine control and controller 22 may contain multiple ROM 26, RAM 28, and KAM 30 coupled to MMU 25 or CPU 24 depending upon the particular application.

In operation, air passes through intake 34 and is distributed to the plurality of cylinders via an intake manifold, indicated generally by reference numeral 36. System 10 preferably includes a mass airflow sensor 38 that provides a corresponding signal (MAF) to controller 22 indicative of the mass airflow. A throttle valve 40 may be used to modulate the airflow through intake 34. Throttle valve 40 is preferably electronically controlled by an appropriate actuator 42 based on a corresponding throttle position signal generated by controller 22. The throttle position signal may be generated in response to a corresponding engine output or demanded torque indicated by an operator via accelerator pedal 46. A throttle position sensor 48 provides a feedback signal (TP) to controller 22 indicative of the actual position of throttle valve 40 to implement closed loop control of throttle valve 40.

A manifold absolute pressure sensor 50 is used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled using a conventional camshaft arrangement, indicated generally by reference numeral 52. Camshaft arrangement 52 includes a camshaft 54 that completes one revolution per combustion or engine cycle, which requires two revolutions of crankshaft 56 for a four-stroke engine, such that camshaft 54 rotates at half the speed of crankshaft 56. Rotation of camshaft 54 (or controller 22 in a variable cam timing or camless engine application) controls one or more exhaust valves 18 to exhaust the combusted air/fuel mixture through an exhaust manifold. A sensor 58 provides a signal from which the rotational position of the camshaft can be determined. Cylinder identification sensor 58 may include a single-tooth or multi-tooth sensor wheel that rotates with camshaft 54 and whose rotation is detected by a Hall effect or variable reluctance sensor. Cylinder identification sensor 58 may be used to identify with certainty the position of a designated piston 64 within cylinder 12 for use in determining fueling, ignition timing, or ion sensing for example.

Additional rotational position information for controlling the engine is provided by a crankshaft position sensor 66 that includes a toothed wheel 68 and an associated sensor 70. In one embodiment, toothed wheel 68 includes thirty-five teeth equally spaced at ten-degree (10°) intervals with a single twenty-degree gap or space referred to as a missing tooth. In combination with cylinder identification sensor 58, the missing tooth of crankshaft position sensor 66 may be used to generate a signal (PIP) used by controller 22 for fuel injection and ignition timing. A time processing unit (TPU) within controller 22 may be used to condition/process the raw rotational position signal generated by position sensor 66 and outputs a signal (PIP) once per cylinder per combustion cycle. Crankshaft position sensor 66 may also be used to determine engine rotational speed and to identify cylinder combustion events based on an absolute, relative, or differential engine rotation speed where desired.

An exhaust gas oxygen sensor 62 provides a signal (EGO) to controller 22 indicative of whether the exhaust gasses are lean or rich of stoichiometry. Depending upon the particular application, sensor 62 may by implemented by a HEGO sensor or similar device that provides a two-state signal corresponding to a rich or lean condition. Alternatively, sensor 62 may be implemented by a UEGO sensor or other device that provides a signal proportional to the stoichiometry of the exhaust feedgas. This signal may be used to adjust the air/fuel ratio, or control the operating mode of one or more cylinders, for example. The exhaust feedgas is passed through the exhaust manifold and one or more emission control or treatment devices 90 before being exhausted to atmosphere.

A fuel delivery system includes a fuel tank 100 with a fuel pump 110 for supplying fuel to a common fuel rail 112 that supplies injectors 80 with pressurized fuel. In some direct-injection applications, a camshaft-driven high-pressure fuel pump (not shown) may be used in combination with a low-pressure fuel pump 110 to provide a desired fuel pressure within fuel rail 112. Fuel pressure may be controlled within a predetermined operating range by a corresponding signal from controller 22. In the representative embodiment illustrated in FIG. 1, fuel injector 80 is side-mounted on the intake side of combustion chamber 14, typically between intake valves 16, and injects fuel directly into combustion chamber 14 in response to a command signal from controller 22 processed by driver 82. Of course, the present disclosure may also be applied to applications having fuel injector 80 centrally mounted through the top or roof of cylinder 14.

Driver 82 may include various circuitry and/or electronics to selectively supply power from high-voltage power supply 120 to actuate a solenoid associated with fuel injector 80 and may be associated with an individual fuel injector 80 or multiple fuel injectors, depending on the particular application and implementation. Although illustrated and described with respect to a direct-injection application where fuel injectors often require high-voltage actuation, those of ordinary skill in the art will recognize that the teachings of the present disclosure may also be applied to applications that use port injection or combination strategies with multiple injectors per cylinder and/or multiple fuel injections per cycle.

In the embodiment of FIG. 1, fuel injector 80 injects a quantity of fuel directly into combustion chamber 14 in one or more injection events for a single engine cycle based on the current operating mode in response to a signal (fpw) generated by controller 22 and processed and powered by driver 82. At the appropriate time during the combustion cycle, controller 22 generates a signal (SA) processed by ignition system 84 to control spark plugs 86, 88 and initiate combustion within chamber 14, and to subsequently apply a high-voltage bias across at least one spark plug 86, 88 to enable ionization current sensing as described herein. Depending upon the particular application, the high-voltage bias may be applied across the spark (air) gap or between the center electrode of spark plug 86, 88 and the wall of cylinder 12. Ignition system 84 may include one or more ignition coils and other circuitry/electronics to actuate associated spark plugs 86, 88 and provide ion sensing. Charging of the ignition coil may be powered by high-voltage power supply 120 or by battery voltage as described with reference to FIGS. 2-5.

As shown in FIG. 1, ignition system 84 may include an isolator/attenuator 94 associated with all but one of the spark plugs 86, 88 of a particular cylinder 12. As described in greater detail with reference to FIGS. 2-5, isolator/attenuator 94 operates to selectively isolate all but one spark plug 88 associated with the cylinder 12 at least during an ionization current sensing period such that ionization current flows through only one spark plug 88 per cylinder 12. Depending on the particular application and implementation, isolator/attenuator 94 may prevent any ionization current from flowing through the conductor associated with spark plug 86 or may attenuate/filter selected frequencies of the ionization current signal, while allowing current to flow through the conductor and associated spark plug(s) during the spark discharge portion of the combustion cycle.

In one embodiment, each cylinder 12 includes a dedicated coil and associated ion sense electronics for firing multiple spark plugs associated with the cylinder. The coil and electronics may be physically located in a coil pack associated with one spark plug 88 of a pair or group of spark plugs associated with a particular cylinder 12, sometimes referred to as a coil-on-plug implementation, with a high-voltage conductor connecting the other spark plugs in the pair/group to the coil pack. The high-voltage conductor may include a separate or integrated isolator/attenuator as described herein, or it may be integrated into the coil pack, for example. Alternatively, a single ignition system 84 may be associated with multiple cylinders 12. In addition, ignition system 84 may include various components to provide selective ionization current sensing or isolation as described with reference to FIGS. 2-5. The representative embodiment illustrated includes at least two spark plugs 86, 88 in each cylinder that are powered by a common ignition coil arranged with dual secondary windings or a center-tapped secondary winding configuration such that both spark plugs 86, 88 generate a spark to ignite a fuel/air mixture within combustion chamber 14 all but one of the spark plugs selectively isolated after the spark discharge period to provide ionization current sensing. Those of ordinary skill in the art may recognize other applications consistent with the teachings of the present disclosure where multiple dual function actuators/ion sensors are used.

Controller 22 includes software and/or hardware implementing control logic to control system 10. Controller 22 generates signals to initiate coil charging and subsequent spark discharge in addition to monitoring an ionization current during an ionization current sensing period after spark discharge. The ionization current signal may be used to provide information relative to combustion quality and timing and to detect various conditions that may include engine knock, misfire, pre-ignition, etc. as known in the art. In one embodiment, controller 22 controls an active isolator/attenuator, such as a transistor or SCR, to selectively isolate all but one of the spark plugs associated with a selected cylinder during an ionization sensing period.

Figure 2:
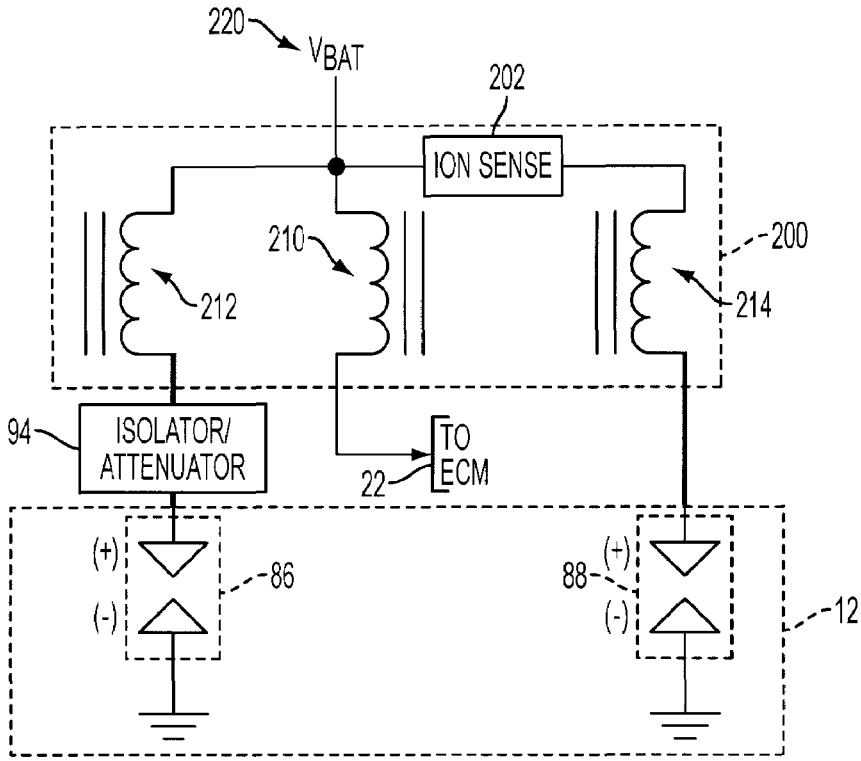
FIG. 2 is a simplified schematic illustrating an ignition coil having dual secondary windings with one spark plug connected via an attenuator/isolator according to one embodiment of the present disclosure.

FIG. 2 is a simplified schematic illustrating one embodiment of a multi-plug-per-cylinder internal combustion engine with ion sensing capability according to the present disclosure. Spark plugs 86, 88 are each associated with a common cylinder 12 and may be disposed symmetrically or asymmetrically within the cylinder through the top and/or side of the cylinder. Spark plugs 86 and 88 are powered by a common ignition coil or coil pack 200 that may be physically positioned on one of the spark plugs, e.g. in a coil-on-plug application, or may be remotely located within the engine compartment. Ignition coil or coil pack 200 may include an ionization sensing module 202 that applies a bias voltage to secondary windings 212, 214 and across at least one of spark plugs 86, 88 during an ionization current sensing period to generate an ionization current and associated voltage/current signal as described in greater detail herein. Alternatively, ionization sensing module 202 may be remotely located within the engine compartment and/or combined with ignition system 84 or controller 22 (FIG. 1).

Ignition coil or pack 200 includes a primary winding 210 electromagnetically coupled to dual secondary windings 212, 214, which may be wound in opposite directions one relative to the other to provide the same voltage polarity across spark plugs 86, 88. Primary winding 210 includes one side connected to a voltage source ($V_{BAT}$) 220, such as a vehicle battery, or alternatively a high-voltage power supply and another side controllably connected to ground through controller 22 to charge ignition coil 200. To initiate a spark, controller 22 opens the primary winding circuit resulting in a rapid collapse of the magnetic field and generation of a spark discharge voltage across spark plugs 86, 88 that exceeds the air gap breakdown voltage of spark plugs 86, 88 resulting in a spark discharge to initiate combustion within cylinder 12 as known in the art. After the spark discharge, ionization sensing module 202 applies a bias voltage to secondary windings 212, 214 during an ionization current sensing period of the combustion cycle. The flame front and ions created during combustion of the air/fuel mixture are generally sufficient to generate a small ionization current through spark plugs 86, 88 (on the order of microamperes) that can be processed by controller 22 to provide information about the timing and quality of combustion. According to the present disclosure, an isolator/attenuator 94 is disposed between all but one of the spark plugs 86, 88 associated with a particular cylinder and ignition coil 200 for attenuating ionization current associated with spark plug 86 during the ionization sensing period. As such, isolator/attenuator 94 selectively electrically isolates spark plug 86 (and any other spark plugs associated with cylinder 12 other than spark plug 88) during the ionization sensing period to reduce or eliminate interference among ionization current signals attributable to spark plugs other than spark plug 88.

Figure 3:
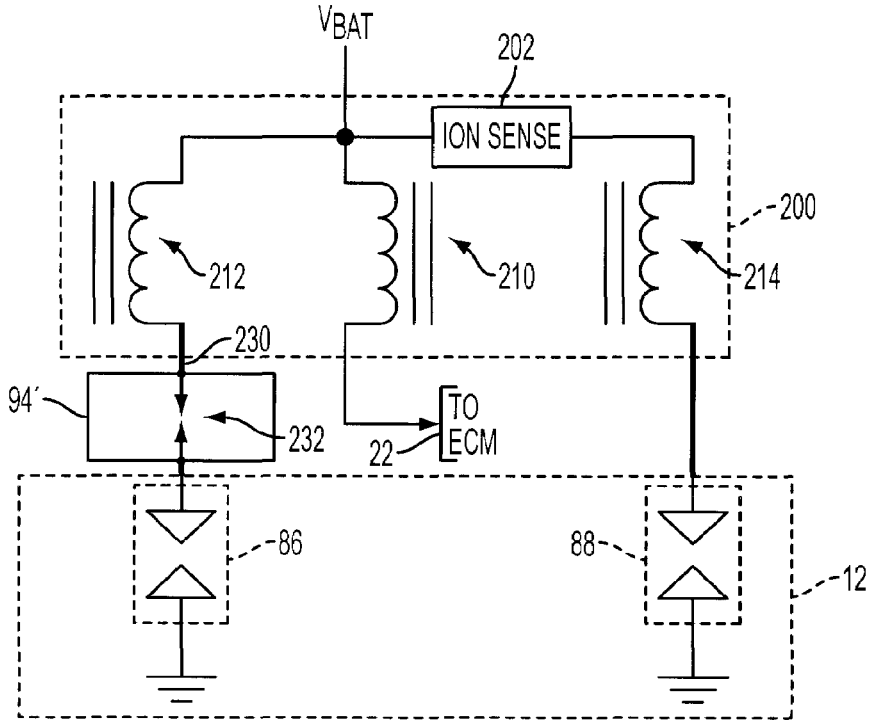
FIG. 3 is a simplified schematic illustrating a spark plug conductor having an air gap to isolate ionization current according to one embodiment of the present disclosure.

FIG. 3 is a simplified schematic of another embodiment of an internal combustion engine having at least two spark plugs associated with a common cylinder to provide ion sensing according to the present disclosure. In the embodiment of FIG. 3, isolator/attenuator 94' is disposed between spark plug 86 and secondary winding 212 of ignition coil 200. Isolator/attenuator 94' may be integrated into connector or conductor 230 that extends from secondary winding 212 to spark plug 86. In one embodiment of an integral attenuator 94', connector 230 includes a gap 232 disposed therein with gap 232 having a breakdown voltage grater than the bias voltage applied by ionization sensing module 202 and substantially less than the spark discharge voltage generated by secondary winding 212 to initiate a spark discharge across the air gap of spark plug 86. Stated differently, gap 232 is significantly smaller and/or may include a dielectric or semi-conducting material so that the conducting voltage to cause current to flow across gap 232 is above the bias voltage of ion sensing module 202 (on the order of 80 volts) but significantly less than the air gap breakdown voltage of spark plug 86 (on the order of tens of kilovolts). Gap 232 blocks any ionization current flow through spark plug 86 during the ionization current sensing period of the combustion cycle.

While a passive isolator/attenuator 94, 94' is illustrated to attenuate ionization current attributable to one or more spark plugs 86, those of ordinary skill in the art will recognize that an active and/or controllable device may be used to attenuate and/or block current through associated spark plugs during an ionization current sensing period. For example, a controllable solid state device such as a transistor, SCR, or similar device may be used selectively isolate all but one spark plug associated with a particular cylinder to reduce or eliminate ionization current contributions attributable to those isolated spark plugs to reduce processing complexity of controller 22 and improve the reliability of the ion sense signal.

FIG. 4 is a simplified schematic illustrating another embodiment of an ignition control system for providing ion sensing in a multi-plug-per-cylinder internal combustion engine. In the embodiment of FIG. 4, isolator/attenuator 94" is integrally implemented by appropriate selection of the impedance characteristics of connector 240, as generally represented by capacitance 242. Those of ordinary skill in the art will recognize that the impedance characteristics of conductor 240, including its overall capacitive, inductive, and/or resistive characteristics, may be selected so that conductor 240 attenuates or filters particular frequencies of the ionization current so that any ionization current signal attributable to spark plug 86 does not adversely impact or interfere with the ionization current signal attributable to spark plug 88. In one embodiment, conductor 240 associated with each selectively isolated spark plugs 86 has a capacitance different from connector 250 to attenuate high frequency components of the ionization current signal flowing through spark plug 86 during the ionization sensing period. As such, selective tuning of connectors 240 associated with isolated/attenuated spark plugs 86 may be used to reduce or eliminate interference among ionization current signals flowing through more than one spark plug.

FIG. 5 is a simplified schematic of another embodiment for an ignition system with ionization current sensing in an internal combustion engine having two or more spark plugs in each cylinder. In the embodiment of FIG. 5, the ignition coil has a primary winding 210' electromagnetically coupled to a center-tapped secondary winding that effectively separates the secondary winding into a first secondary winding 212' and a second secondary winding 214' with center tap conductor 216 connected to one side of primary winding 210'. As in previous embodiments, secondary windings 212', 214' may be wound in opposite directions to generate voltage of the same polarity across spark plugs 86, 88 during the spark discharge. The embodiment of FIG. 5 functions in a similar manner as previously described embodiments with an isolator/attenuator 94 connected between secondary winding 212' and spark plug 86 that attenuates ionization current associated with all but one of the spark plugs associated with a particular cylinder during the ionization current sensing period. Ion sense module 202 includes opposite sense zener diodes 270, 272, a capacitor 280 and a voltage divider 284 having series connected resistors 286, 288. Controller 22 connects primary winding 210' to ground to charge the coil and electromagnetically couple secondary windings 212', 214'. Controller 22 then opens the circuit to collapse the magnetic field and generate a high voltage across secondary windings 212', 214'. This high voltage is also applied across ionization sensing module 202 and spark plugs 86, 88. Zener diode 270 connected in parallel with capacitor 280 operates to charge capacitor 280 to the bias voltage, typically in the range of 80V-100V, for example. As the voltage across secondary windings 212', 214' decreases during the spark discharge to a value below the bias voltage of capacitor 280, the bias voltage of capacitor 280 is applied across secondary windings 212', 214' and across at least one spark plug 86, 88. The propagating flame and ions generated as the fuel/air mixture combusts within the cylinder lowers the conducting voltage across the spark plug gaps so that a small ionization current flows through spark plug 88, but is attenuated or prevented from flowing through spark plug 86 by isolator/attenuator 94. As such, the ionization signal 260 produced across the voltage divider 284 and provided to controller 22 is attributable to only one spark plug 88 with any contribution attributable to spark plug 86 reduced or eliminated.

As such, the present disclosure includes embodiments that provide ionization current sensing in applications having two or more spark plugs or other ionization sensors for each cylinder that are powered from a common coil or conductor. Using a common power source may reduce cost relative to applications that have an ionization sensing coil for each plug while still providing ionization current sensing for each cylinder. Attenuating or isolating all but one plug associated with a particular cylinder reduces signal processing complexity and may result in more reliable ionization current signals that are better correlated with combustion timing and efficiency.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed:

1. An engine comprising:

at least two spark plugs per cylinder powered by a common ignition coil;

an ionization sensing module that applies a bias voltage across the at least two spark plugs during an ionization sensing period; and an attenuator disposed in series between all but one of the at least two spark plugs associated with the cylinder and the ignition coil for attenuating ionization current associated with all but one of the spark plugs.

2. The engine of claim 1 wherein the attenuator prevents ionization current flowing through all but one of the at least two spark plugs associated with the cylinder.

3. The engine of claim 1 wherein the attenuator filters selected frequencies of ionization current signals attributable to all but one of the spark plugs associated with the cylinder.

4. The engine of claim 1 wherein the engine includes two spark plugs per cylinder and wherein the attenuator comprises a connector having an integral attenuator and extending from the ignition coil to one of the spark plugs.

5. The engine of claim 4 wherein the integral attenuator comprises an air gap disposed within the connector, the air gap having a breakdown voltage greater than the bias voltage applied by the ionization sensing module and substantially less than a spark discharge voltage applied by the ignition coil.

6. The engine of claim 4 wherein the integral attenuator comprises an electrical conductor having an associated capacitance that attenuates selected frequencies of the ionization current signal.

7. The engine of claim 1 further comprising:

an ignition coil having a primary winding and a plurality of secondary windings electromagnetically coupled to the primary winding, each secondary winding connected to one of the at least two spark plugs such that all of the at least two spark plugs associated with the cylinder are actuated substantially simultaneously.

8. The engine of claim 7 wherein the ignition coil includes first and second secondary windings wound in opposite directions to apply the same voltage polarity across two spark plugs associated with the cylinder.

9. The engine of claim 7 wherein the ignition coil comprises first and second secondary windings with a center tap therebetween connected to one side of the primary winding.

10. A method for controlling an internal combustion engine having at least two spark plugs per cylinder connected to a common ignition coil, the method comprising:

selectively isolating all but one spark plug associated with the cylinder at least during an ionization current sensing period to reduce or eliminate interference among ionization current signals flowing through more than one spark plug.

11. The method of claim 10 wherein selectively isolating comprises:

applying an ionization bias voltage across all spark plugs associated with a cylinder; and attenuating ionization current associated with all but one of the spark plugs associated with the cylinder.

12. The method of claim 11 wherein attenuating ionization current comprises blocking ionization current flow through all but one of the spark plugs associated with the cylinder.

13. The method of claim 12 wherein blocking ionization current flow comprises providing an air gap between all but one of the spark plugs associated with the cylinder and the corresponding ignition coil, the air gap having a breakdown voltage that exceeds the ionization bias voltage and is substantially less than the air gap breakdown voltage of associated spark plugs.

14. The method of claim 11 wherein attenuating ionization current comprises attenuating selected frequencies of ion current signals attributable to all but one of the spark plugs associated with the cylinder.

15. The method of 11 wherein the engine includes two spark plugs per cylinder and wherein applying an ionization bias voltage comprises:

applying an ionization voltage to a secondary winding center tap of the ignition coil during an ionization current sensing period of each combustion cycle.

16. The method of claim 11 wherein attenuating ionization current comprises:

connecting all but one of the spark plugs associated with the cylinder to the ignition coil with a connector having a first frequency response that attenuates selected frequencies of an ionization current signal; and connecting one of the spark plugs associated with the cylinder to the ignition coil with a connector having a second frequency response that attenuates the selected frequencies of the ionization current signal less than the first frequency response.

17. The method of claim 11 wherein attenuating ionization current comprises connecting all but one of the spark plugs associated with the cylinder using a conductor having a capacitance selected to attenuate selected frequencies of the ionization current signal.

18. A multiple cylinder internal combustion engine comprising:

first and second spark plugs associated with each cylinder;

an ignition coil having a primary winding electromagnetically coupled to a first secondary winding wound in a first direction and a second secondary winding wound in an opposite direction to provide like polarity voltage across the two spark plugs;

an ionization sensing module associated with each cylinder and applying a bias voltage across both the first and second spark plugs during an ionization sensing period of a combustion cycle and generating a corresponding ionization current signal;

wherein the first spark plug is connected to the first secondary winding such that any ionization current flowing through the first spark plug is attenuated relative to any ionization current flowing through the second spark plug.

19. The internal combustion engine of claim 18 further comprising:

a connector disposed between the first spark plug and the ignition coil, the connector having an air gap disposed therein with an associated conducting voltage that exceeds the bias voltage.

20. The internal combustion engine of claim 18 further comprising:

a connector disposed between the first spark plug and the ignition coil, the connector having an associated capacitance different from any connector disposed between the second spark plug and the ignition coil to attenuate high frequency components of the ionization current signal flowing through the first spark plug.

* * * * *